US008424930B2

(12) United States Patent
Matsubara et al.

(10) Patent No.: US 8,424,930 B2
(45) Date of Patent: Apr. 23, 2013

(54) INCUBATOR

(75) Inventors: Terumi Matsubara, Saitama (JP); Eiji Koike, Saitama (JP); Naoki Honma, Saitama (JP); Yoko Nagai, Chiba (JP); Kazuo Matsubara, Tokyo (JP)

(73) Assignee: Atom Medical Corporation, Tokyo (JP)

( * ) Notice: Subject to any disclaimer, the term of this patent is extended or adjusted under 35 U.S.C. 154(b) by 530 days.

(21) Appl. No.: 12/568,335

(22) Filed: Sep. 28, 2009

(65) Prior Publication Data

US 2010/0109347 A1 May 6, 2010

(30) Foreign Application Priority Data

Oct. 3, 2008 (JP) ..... 2008-258291

(51) Int. Cl.
*E05C 19/10* (2006.01)
*E05C 3/12* (2006.01)

(52) U.S. Cl.
USPC ..... 292/121; 292/122; 292/128; 292/219; 292/220; 292/228; 292/DIG. 37

(58) Field of Classification Search ..... 292/121, 292/122, 124, 127, 128, 219, 220, 224, 227, 292/228, DIG. 37
See application file for complete search history.

(56) References Cited

U.S. PATENT DOCUMENTS

| | | | | |
|---|---|---|---|---|
| 2,233,699 | A * | 3/1941 | Gorrell | 292/227 |
| 2,618,140 | A * | 11/1952 | Zellweger | 431/152 |
| 4,896,908 | A * | 1/1990 | Kleefeldt | 292/216 |
| 5,280,755 | A * | 1/1994 | Batur | 109/59 R |
| 5,820,174 | A * | 10/1998 | Parikh et al. | 292/126 |
| 5,823,644 | A * | 10/1998 | Suh et al. | 312/223.2 |
| 5,875,795 | A * | 3/1999 | Bouix | 132/293 |
| 5,984,383 | A * | 11/1999 | Parikh et al. | 292/121 |
| 6,592,511 | B2 | 7/2003 | Honma et al. | |
| 7,347,460 | B2 * | 3/2008 | Ala | 292/216 |
| 7,441,813 | B2 * | 10/2008 | Qin et al. | 292/163 |
| 7,552,951 | B2 * | 6/2009 | Kim | 292/113 |
| 7,806,446 | B2 * | 10/2010 | Oh | 292/165 |

FOREIGN PATENT DOCUMENTS

| | | |
|---|---|---|
| EP | 0 368 207 | 5/1990 |
| JP | 10-248887 | 9/1998 |
| JP | 10-258097 | 9/1998 |
| JP | 2001/070373 | 9/1999 |
| JP | 2000/070315 | 3/2000 |

* cited by examiner

*Primary Examiner* — Carlos Lugo
(74) *Attorney, Agent, or Firm* — Hunton & Williams LLP

(57) ABSTRACT

In an incubator according to the present invention, physical condition of a newborn is less likely to get out of order though a hand insertion window can easily be opened by operation with, for example, an elbow instead of a hand. A latch in a latch mechanism has a spiral face that extends to at least part of the periphery of a rotation shaft that extends along a side of a newborn chamber. A releasing member in the latch mechanism presses the spiral face of the latch by movement along the side of the newborn chamber and rotates the latch from a holding position to a releasing position for a hand insertion door. In addition, even if the latch in the latch mechanism rotates about the rotation shaft between the holding and releasing positions for the hand insertion door, the releasing member does not rotate.

13 Claims, 10 Drawing Sheets

INCUBATOR

TECHNICAL FIELD

The present invention relates to an incubator that includes: a hand insertion window formed in a side of a newborn chamber; a hand insertion door that opens and closes the hand insertion window by rotation; and a latch mechanism that holds the hand insertion door in a closing position.

BACKGROUND ART

An incubator has a newborn chamber to provide appropriate physiological environment for a newborn that cannot adjust its body temperature and others by itself. Substantially entire areas of the sides and top of a newborn chamber are formed from transparent members so that a newborn in the newborn chamber can be seen from the outside. Within the newborn chamber, not only temperature but also humidity, oxygen concentration and others are controlled. A treating person, however, such as a doctor or a nurse gives treatment to a newborn in a newborn chamber, when necessary. Therefore, for relatively simple treatments, hand insertion windows are formed in certain sides of the newborn chamber. Additionally, the incubator has a hand insertion door that opens and closes the hand insertion window by rotation, and a latch mechanism that holds the hand insertion door in a closing position.

In order that appropriate physiological environment in the newborn chamber is maintained for a newborn, it is usual that hand insertion windows are closed by hand insertion doors and that the hand insertion doors are held in their closing positions by their corresponding latch mechanisms. In order to treat a newborn, however, each hand insertion window has to be opened by rotating its hand insertion door to its opening position from its closing position. On the other hand, a treating person may have in its both hands a medical device, medical drug, or others for treating a newborn. Additionally, there may be a case where contamination of sterilized both hands has to be prevented. To meet such needs, conventional incubators (e.g., Patent Literatures 1 and 2) have a releasing member for releasing a latch mechanism such that the hand insertion window can easily be opened by only pressing the releasing member in a direction perpendicular to the corresponding side face of a newborn chamber with, for example, an elbow instead of a hand.

Citation List

Patent Literature

1. JP 2001-70373 A
2. JP 2-198554 A

SUMMARY OF INVENTION

Technical Problem

In the conventional incubators mentioned above, however, a hand insertion window can be opened by only pressing each releasing member in a direction perpendicular to the corresponding side of a newborn chamber. Therefore, if a treating person or others leans on the releasing member or the releasing member comes into contact with a wall during conveyance of the incubator, the hand insertion window may be opened unintentionally. Furthermore, in the conventional incubators mentioned above, there can happen a state where, although a hand insertion door is almost in contact with a latch mechanism, this hand insertion door is not securely held in its closing position and, therefore, the corresponding hand insertion window is incompletely closed. If the hand insertion window is unintentionally opened or incompletely closed when a newborn is in the newborn chamber, the inside of the newborn chamber will deviate from appropriate physiological environment for the newborn, and there is the possibility that the physical condition of the newborn gets out of order.

Furthermore, in the conventional incubators mentioned above, the hand insertion door can rotate freely while it is not held in its closing position by the latch mechanism. Additionally, also the latch mechanism is suddenly activated by urging force when it holds the hand insertion door in its closing position. For these reasons, the hand insertion door or latch mechanism may bump against another part of the incubator. Noise and vibration by impact resulting from this bump may put stress on a newborn in the newborn chamber, and there is the additional possibility that the physical condition of the newborn gets out of order. It is accordingly an object of the present invention to provide an incubator designed such that the physical condition of a newborn is less likely to get out of order though a hand insertion window can easily be opened by operation with, for example, an elbow instead of a hand.

Solution to Problem

In an incubator according to the present invention, a latch in a latch mechanism has a spiral face that extends to at least part of the periphery of a rotation shaft that extends along a side of a newborn chamber. A releasing member in the latch mechanism presses the spiral face of the latch by movement along the side of the newborn chamber, and rotates the latch about the rotation shaft from a holding position to a releasing position for a hand insertion door. Accordingly, a hand insertion window can be opened by only pressing and moving the releasing member in the latch mechanism along the side of the newborn chamber.

Additionally, in order to open the hand insertion window, the releasing member in the latch mechanism has to be pressed along the side of the newborn chamber. Accordingly, even if a treating person or others leans on the releasing member or the releasing member comes into contact with a wall during conveyance of the incubator, the hand insertion window will not be opened. In addition, even if the latch in the latch mechanism rotates between the holding and releasing positions for the hand insertion door, the releasing member does not rotate, and therefore impact due to activation of the latch mechanism is less likely to occur.

In another incubator according to the present invention, in the course of rotation of the hand insertion door in the direction in which the hand insertion window is closed, an opening mechanism comes into contact with the hand insertion door before the hand insertion window is closed. Thereby, the opening mechanism urges the hand insertion door so as to rotate in the direction in which the hand insertion window is opened. Therefore, if the hand insertion window is not completely closed, the hand insertion window is opened, and it is easily aware that the hand insertion window is not closed. Accordingly, the hand insertion window is more likely to be again closed.

In another incubator according to the present invention, a pressed portion, which is pressed by rotation of the hand insertion door, of the latch in the latch mechanism is made of impact-absorbent material. Accordingly, even if the hand insertion door bumps against the latch when the hand insertion door is rotated to close the hand insertion window, impact is less likely to occur.

In another incubator according to the present invention, from some point in the course of rotation of the hand insertion door in the direction in which the hand insertion window is opened, a braking mechanism brakes the rotation of the hand insertion door. Accordingly, the hand insertion door does not stop suddenly when the hand insertion window has completely been opened, and impact is less likely to occur when the hand insertion window has completely been opened.

In another incubator according to the present invention, an urging member in the latch mechanism urges the latch so as to rotate the latch from the releasing position to the holding position. Accordingly, if the latch is only rotated to the releasing position, the latch rotates automatically from the releasing position to the holding position without being manually rotated from the releasing position to the holding position and holds the hand insertion door. Nevertheless, a braking member in the latch mechanism brakes rotation of the latch. Accordingly, even if the latch rotates automatically from the releasing position to the holding position, impact is less likely to occur at the holding position.

Advantageous Effects of Invention

In the incubator according to the present invention, the hand insertion window can be opened by only pressing and moving the releasing member in the latch mechanism along the side of the newborn chamber. Accordingly, the hand insertion window can easily be opened by operation with, for example, an elbow instead of a hand. Additionally, even if a treating person or others leans on the releasing member or the releasing member comes into contact with a wall during conveyance of the incubator, the hand insertion window will not be opened. Therefore, the inside of the newborn chamber is less likely to deviate from appropriate physiological environment for a newborn. Furthermore, impact due to the activation of the latch mechanism is less likely to occur. Therefore, less stress is put on a newborn in the newborn chamber when the latch mechanism is activated. Accordingly, the physical condition of the newborn is less likely to get out of order.

In the other incubator according to the present invention, if the hand insertion window is not completely closed, the hand insertion window is opened, and it is easily aware that the hand insertion window is not closed. Therefore, the hand insertion window is more likely to be again closed. Accordingly, the inside of the newborn chamber is less likely to deviate from appropriate physiological environment for a newborn, and physical condition of the newborn is less likely to get out of order.

In the other incubator according to the present invention, even if the hand insertion door bumps against the latch when the hand insertion door is rotated to close the hand insertion window, impact is less likely to occur. Accordingly, less stress is put on the newborn in the newborn chamber when the hand insertion window is close, and physical condition of the newborn is less likely to get out of order.

In the other incubator according to the present invention, the hand insertion door does not stop suddenly when the hand insertion window has completely been opened, and impact is less likely to occur when the hand insertion window has completely been opened. Accordingly, less stress is put on the newborn in the newborn chamber when the hand insertion window is opened, and physical condition of the newborn is less likely to get out of order.

In the other incubator according to the present invention, if the latch in the latch mechanism is only rotated to the releasing position, the latch rotates automatically from the releasing position to the holding position without being manually rotated from the releasing position to the holding position and holds the hand insertion door. Accordingly, it is easy to close the hand insertion window with the hand insertion door. Nevertheless, even if the latch rotates automatically from the releasing position to the holding position, impact is less likely to occur at the holding position. Accordingly, less stress is put on the newborn in the newborn chamber when the hand insertion window is opened, and physical condition of the newborn is less likely to get out of order.

BRIEF DESCRIPTION OF DRAWINGS

FIG. 10 One of a pair of left and right hand insertion doors and one of a pair of left and right latch mechanisms of the incubator according to the embodiment of the present invention, in which (a) is a front view and (b) is a sectional view taken along a line B-B in (a).

DESCRIPTION OF EMBODIMENTS

Hereinafter, referring to FIGS. 1 to 11, there will be described one embodiment of the present invention applied to a switching type incubator capable of switching between a closed type and open type as required by lowering or raising a canopy of a newborn chamber. Hereinafter, the present embodiment will be described according to the following list.

Figure 11:
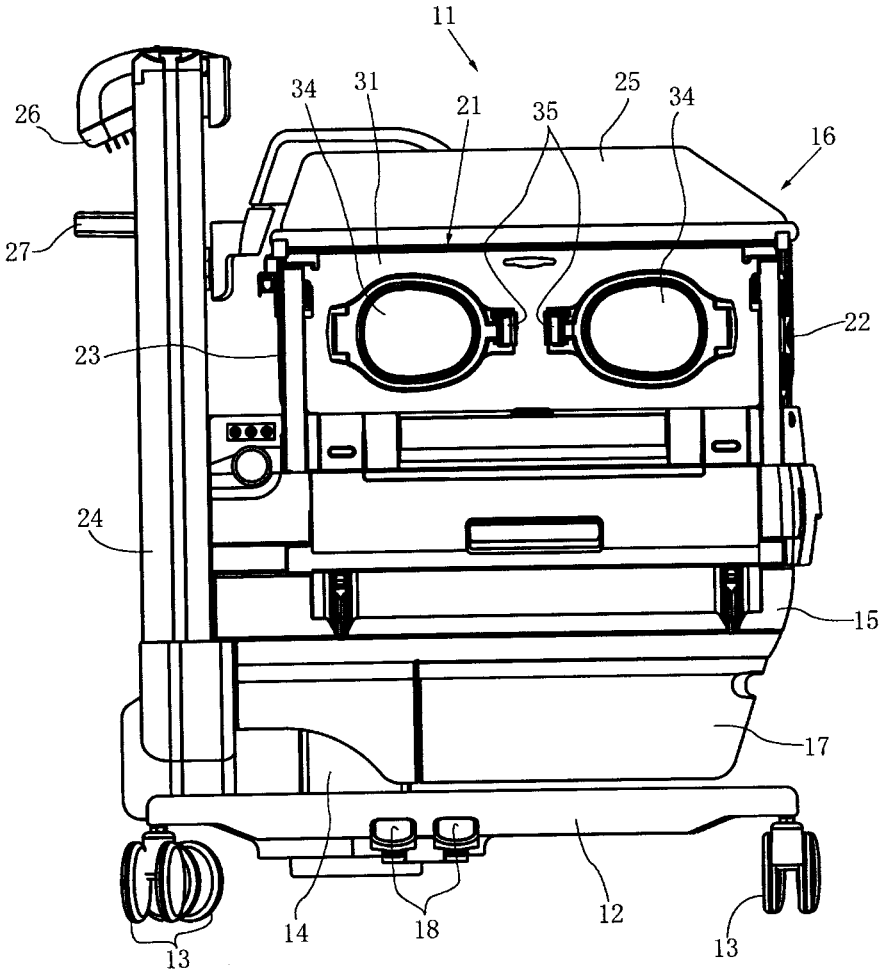
FIG. 11 Side view of an incubator according to the embodiment of the present invention where the incubator is in a closed type.

(1) An Outline of the Overall Incubator
(2) Opening and Closing of the Hand Insertion Window
(3) Awareness of any Unclosed State of the Hand Insertion Window
(4) Making Operation of Opening and Closing the Hand Insertion Window Quiet (1) An Outline of the Overall Incubator FIG. 11 shows an incubator of the present embodiment in a closed type. In the incubator 11, wheels 13 and a support 14 are attached to a frame 12. A base 15 is supported on the support 14. Within the base 15 is a control mechanism (not shown) for temperature, humidity and others. Disposed on the base 15 is a newborn chamber 16. A drawer 17 for use as storage is attached to the underside of the base 15. Pedals 18 are also attached to the frame 12 in order to adjust the height of the base 15 or others along the support 14.

A bed (not shown) is disposed in the newborn chamber 16. Formed in the sides of the newborn chamber 16 are: a pair of left and right treatment doors 21 which is located on the left and right sides of a newborn (not shown) lying on the bed; a foot end treatment door 22 which is located at the foot end; and a head end treatment wall 23 which is located at the head end. A pair of left and right posts 24 is also attached to the frame 12. Another post (not shown) is nested in the post 24. The other post is slidable within the post 24.

A canopy 25 of the newborn chamber 16 and an infrared heater 26 are supported respectively by one and the other of the other left and right posts nested in posts 24. By sliding these other posts within the corresponding posts 24, the canopy 25 and infrared heater 26 can be raised or lowered independently. The canopy 25 is also made of transparent material. Attached also to the posts 24 is a protector 27 that prevents the infrared heater 26 from bumping against the wall (not shown) of a room.

(2) Opening and Closing of the Hand Insertion Window

The left and right treatment doors 21 each have an outer wall 31 and an inner wall 32 (see FIG. 9) that are transparent and form a double-wall structure. Each outer wall 31 and the corresponding inner wall 32 have: a pair of left and right hand insertion windows 33 (see FIG. 9); a pair of left and right hand insertion doors 34 for closing and opening the corresponding hand insertion windows 33; and latch mechanisms 35 for holding the corresponding hand insertion doors 34 in their closing positions for closing the corresponding hand insertion windows 33. FIG. 10 shows one of the pair of hand insertion doors 34 and the corresponding latch mechanism 35.

Figure 5:
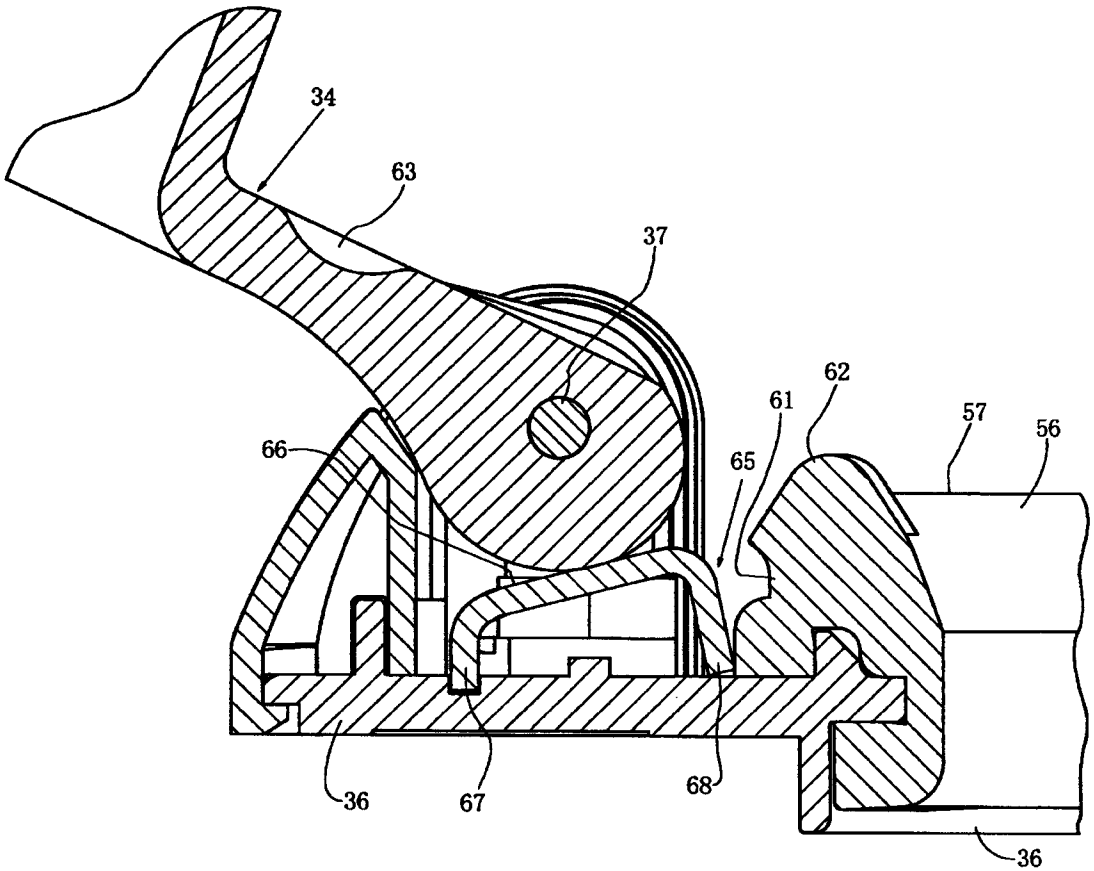
FIG. 5 Partial sectional view of the hand insertion window of the incubator according to the embodiment of the present invention, in which the hand insertion door is in an opening position.
Figure 9:
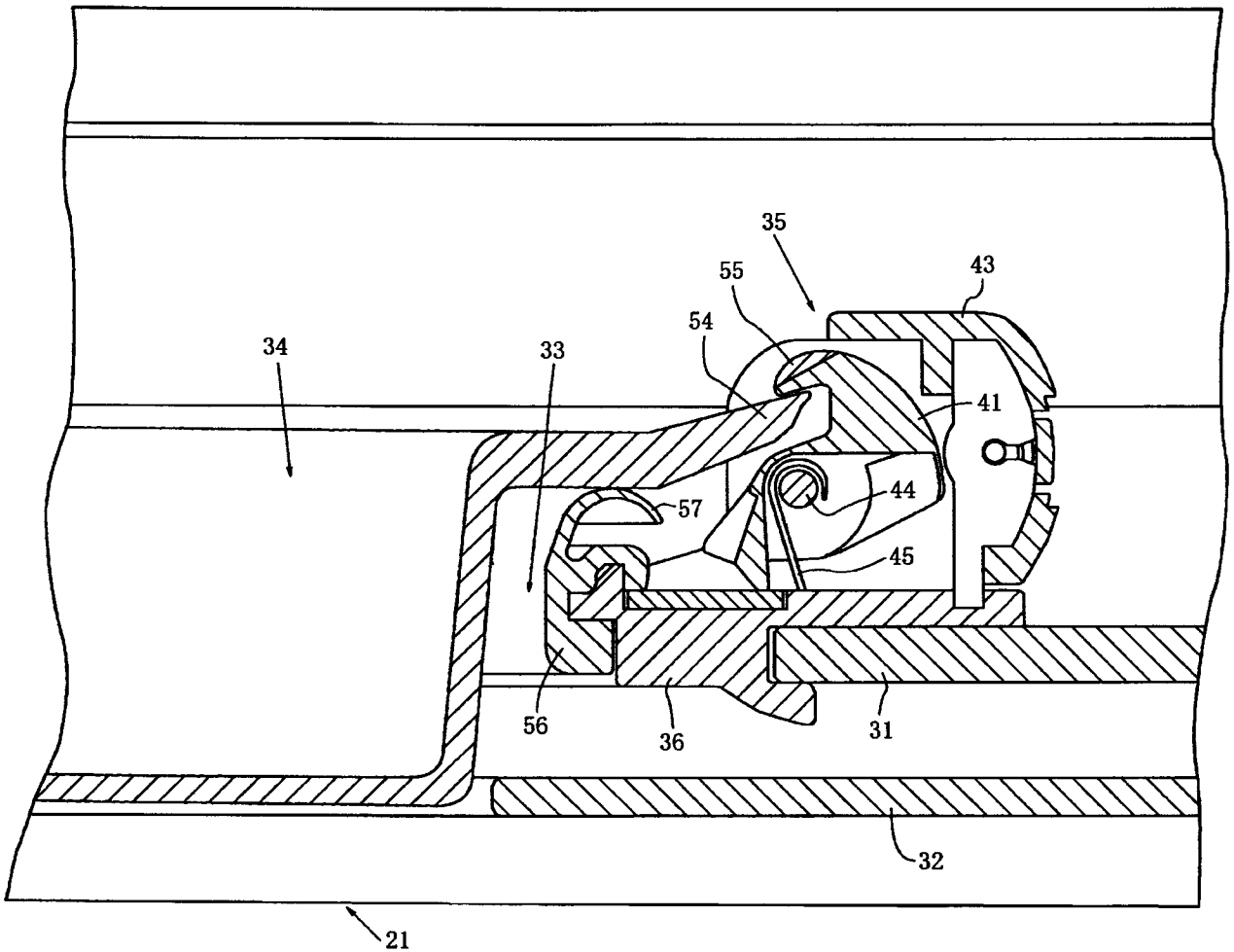
FIG. 9 Sectional view of the latch mechanism of the incubator according to the embodiment of the present invention, in which the hand insertion door has been held by the latch.
Figure 1O:
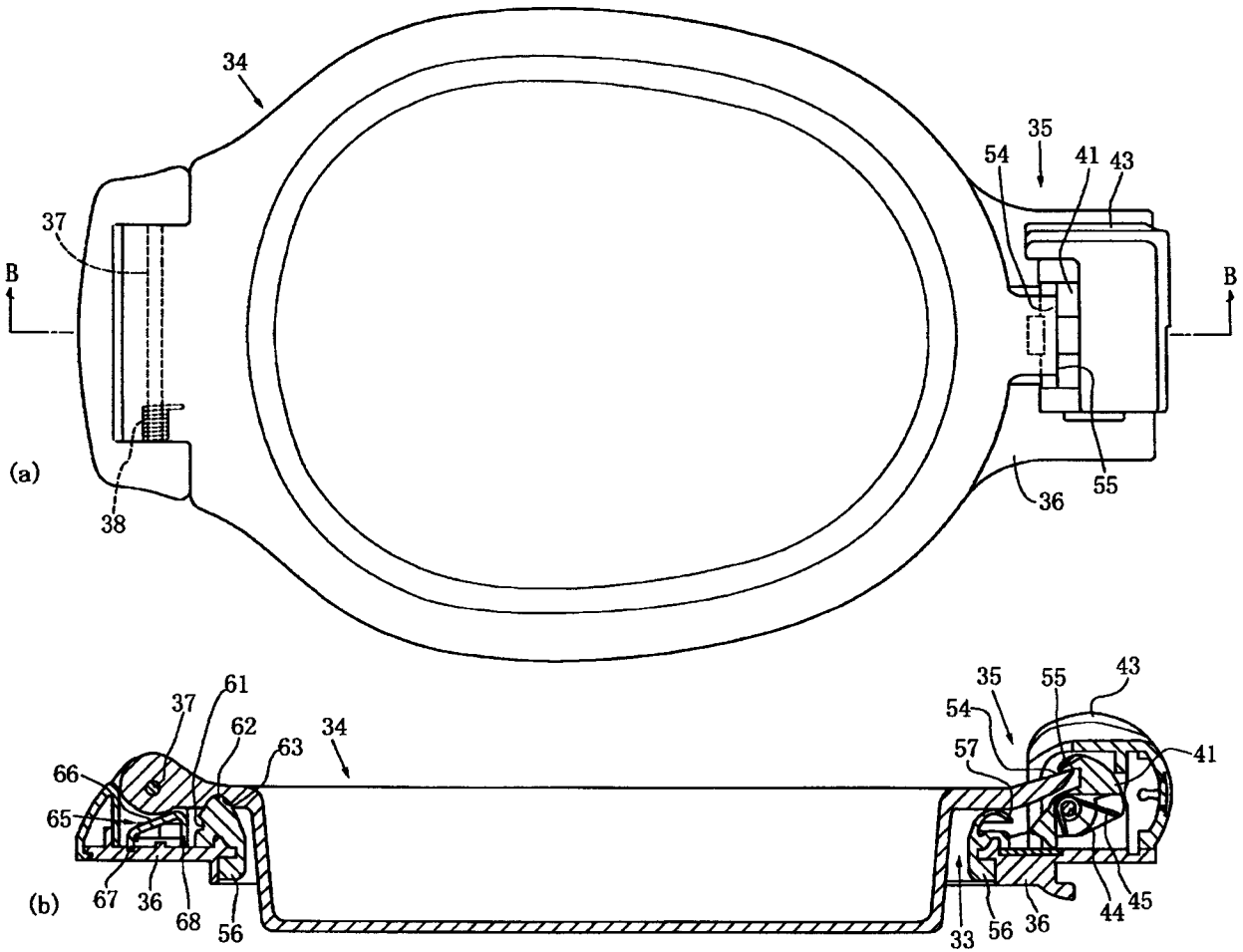

A hand-insertion-door base plate 36 of annular shape and made of transparent rigid synthetic resin is fitted and screwed to the internal edge of the outer wall 31 of the hand insertion window 33 of the newborn chamber 16. The hand insertion door 34 is also made of a transparent rigid synthetic resin and has a dish-like shape. The hand insertion door 34 is supported diametrically opposite the latch mechanism 35 on the edge of the hand-insertion-door base plate 36. The hand insertion door 34 is rotatable about a rotation shaft 37 between a closing position in which the hand insertion door 34 closes the hand insertion window 33 as shown in FIGS. 9 and 10 and an opening position in which it opens the hand insertion window 33 as shown in FIG. 5. The hand insertion door 34 is urged from the above-mentioned closing position toward the above-mentioned opening position by a helical coil spring 38 in which the rotation shaft 37 is inserted.

Figure 1:
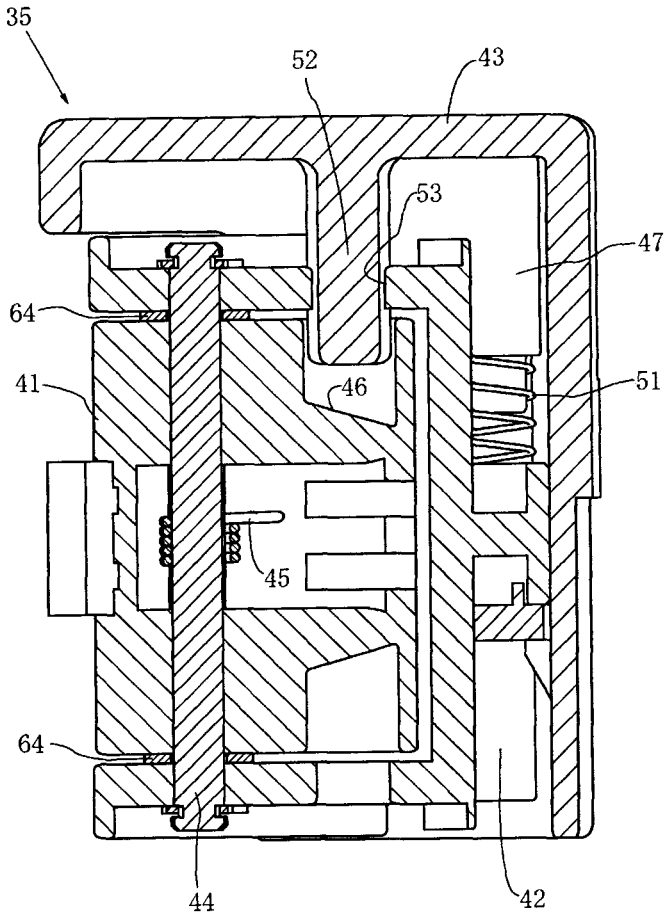
FIG. 1 Sectional view of a latch mechanism of an incubator according to one embodiment of the present invention.
Figure 8:
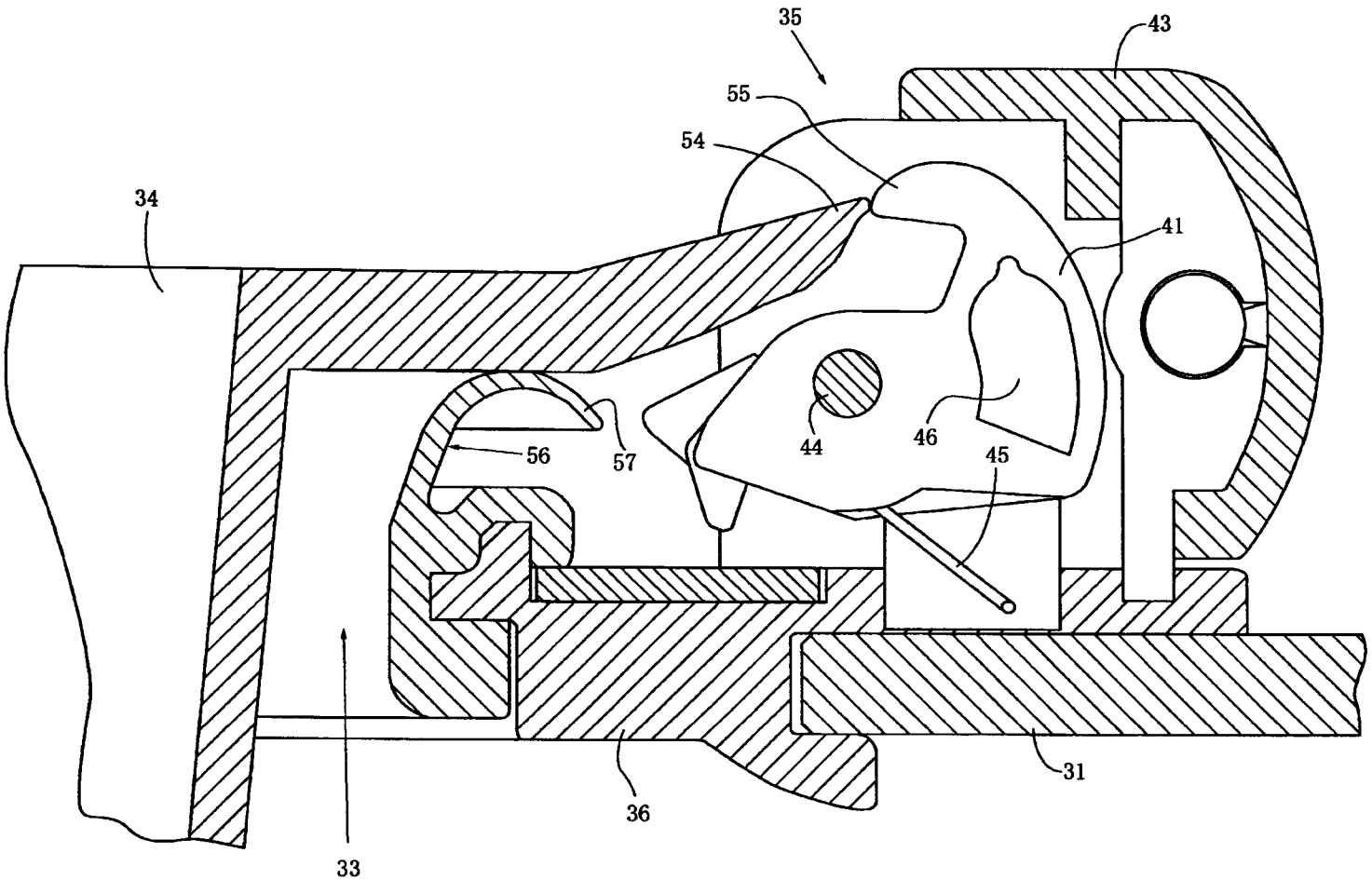
FIG. 8 Sectional view of the latch mechanism of the incubator according to the embodiment of the present invention, in which the latch has rotated to its releasing position.

FIG. 1 shows the latch mechanism 35 in FIGS. 10 and 11. The latch mechanism 35 includes a latch 41, a latch base plate 42, and a releasing member 43. The latch base plate 42 is fixed to the hand-insertion-door base plate 36. The latch 41 and the releasing member 43 are supported by the latch base plate 42. The latch 41 is rotatable about a rotation shaft 44 between a holding position in which the latch 41 holds the hand insertion door 34 in the closing position as shown in FIGS. 9 and 10 and a releasing position in which it releases the holding as shown in FIG. 8.

Figure 2:
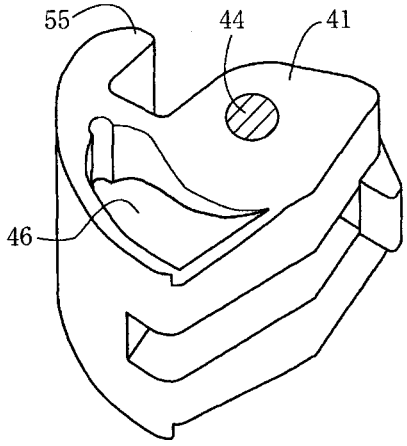
FIG. 2 Perspective view of a latch in the latch mechanism of the incubator according to the embodiment of the present invention.

A helical coil spring 45, in which the rotation shaft 44 is inserted, is interposed between the latch 41 and the latch base plate 42. The latch 41 is urged by the helical coil spring 45 from the releasing position to the holding position. As shown in FIG. 2, the latch 41 has a spiral face 46 that extends to part of the periphery of the rotation shaft 44.

As shown in FIG. 1, interposed between the releasing member 43 and the latch base plate 42 are a column 47 and a helical compression spring 51. The releasing member 43 is urged by the helical compression spring 51 in a direction extending from the base 15 toward the canopy 25, that is, upward along the outer wall 31 of the newborn chamber 16. In addition, a projection 52 is formed integrally with the releasing member 43 so as to be parallel with the column 47 and the helical compression spring 51. This projection 52 extends to an area above the spiral face 46 through an opening 53 made in the latch base plate 42.

Figure 7:
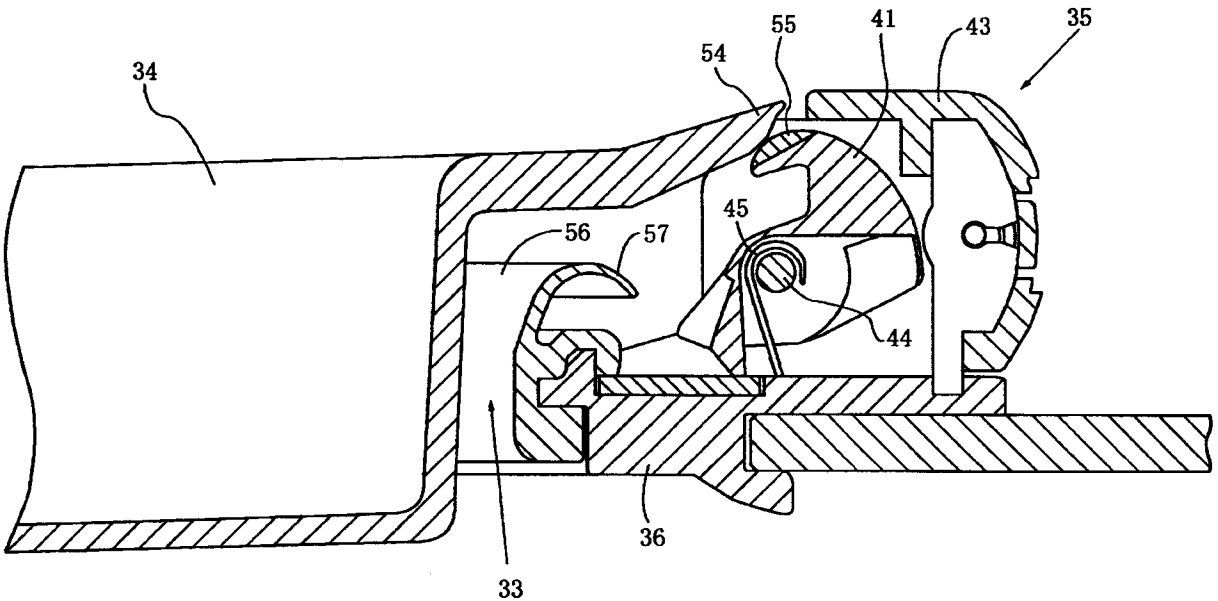
FIG. 7 Sectional view of a latch mechanism of the incubator according to the embodiment of the present invention, in which the hand insertion door is in contact with the latch.

In order to shift the hand insertion door 34 from the state in which the hand insertion door 34 opens the hand insertion window 33 as shown in FIG. 5 to the state in which it closes the hand insertion window 33 as shown in FIGS. 9 and 10, the hand insertion door 34 is rotated against the urge applied from the helical coil spring 38. Thereby, as shown in FIG. 7, a tongue portion 54, which is the rotating leading-end of the hand insertion door 34, presses a pressed portion 55 of the latch 41 which is in the holding position. With pressing by the tongue portion 54, the latch 41 rotates about the rotation shaft 44 to the releasing position, as shown in FIG. 8, against the urge applied from the helical coil spring 45.

With further rotation of the hand insertion door 34 from the releasing position shown in FIG. 8, the tongue portion 54 of the hand insertion door 34 moves past the pressed portion 55 of the latch 41 towards the rotation shaft 44, and the latch 41 is rotated up to the holding position by the urge applied from the helical coil spring 45, as shown in FIGS. 9 and 10. As a result, the hand insertion door 34 is held by the latch 41 and the hand insertion door 34 closes the hand insertion window 33.

On the other hand, in order to shift the hand insertion door 34 from the state in which the hand insertion door 34 closes the hand insertion window 33 as shown in FIGS. 9 and 10 to the state in which it opens the hand insertion window 33 as shown in FIG. 5, the releasing member 43 is pressed down in a direction extending from the canopy 25 toward the base 15, that is, downward along the outer wall 31 of the newborn chamber 16, against the urge of the releasing member 43. The urge of the releasing member 43 is applied from the helical compression spring 51 in a direction extending from the base 15 toward the canopy 25, that is, upward along the outer wall 31 of the newborn chamber 16. When the releasing member 43 is pushed down, the projection 52 of the releasing member 43 moves downward through the opening 53 and presses the spiral face 46 of the latch 41.

As a result of pressing the releasing member 43, the latch 41 rotates about the rotation shaft 44 from the holding position to the releasing position against the urge applied from the helical coil spring 45. Consequently, the tongue portion 54 of the hand insertion door 34 is released from being held by the latch 41, and the hand insertion door 34 is rotated by the urge applied from the helical coil spring 38. Accordingly, the hand insertion door 34 opens the hand insertion window 33. When the releasing member 43 is released from being pressed down, the projection 52 of the releasing member 43 is moved upward through the opening 53 by the urge applied from the helical compression spring 51, and the projection 52 separates from the spiral face 46 of the latch 41 due to this upward movement. Accordingly, the latch 41 returns from the releasing position to the holding position by the urge applied from the helical coil spring 45.

(3) Awareness of any Unclosed State of the Hand Insertion Window

Figure 3:
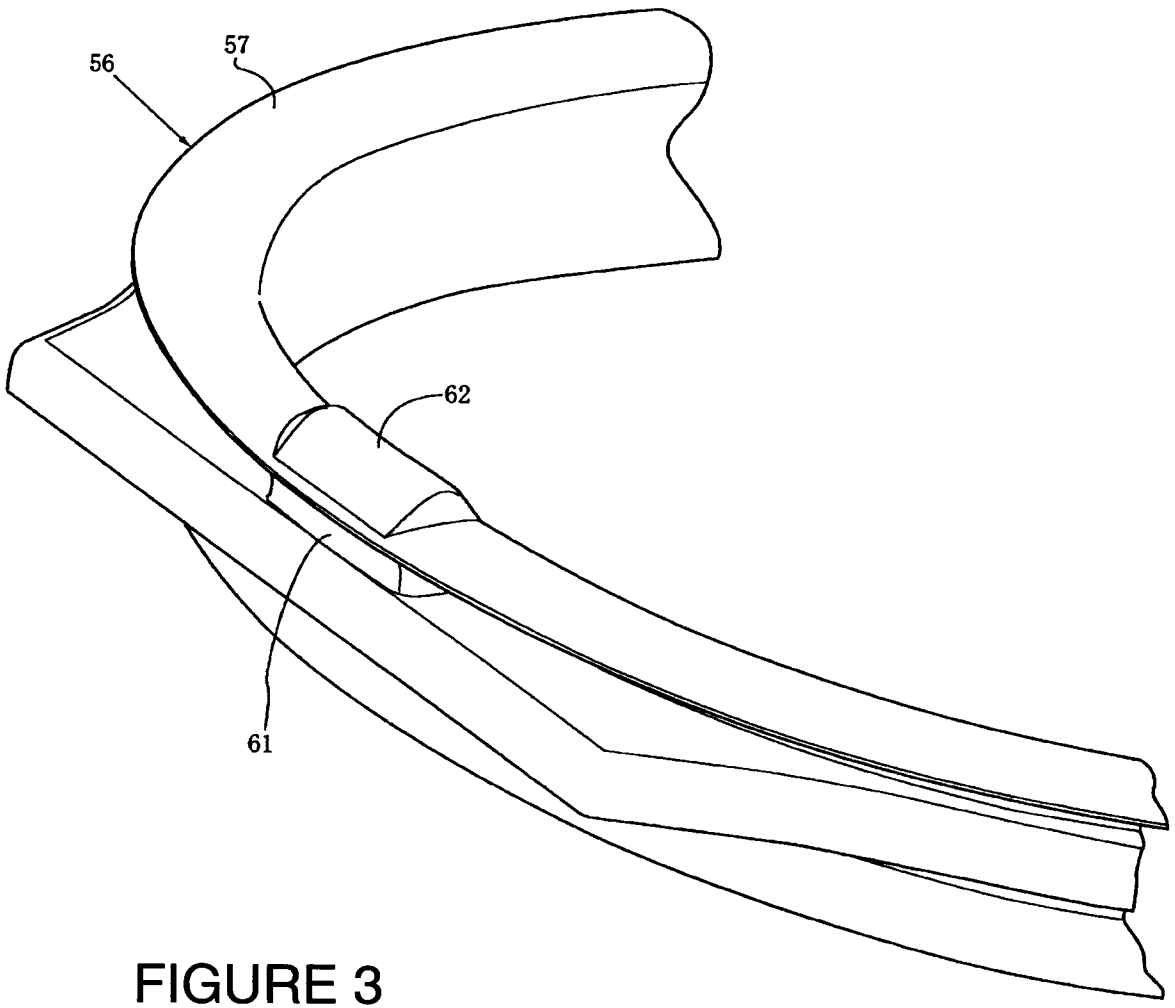
FIG. 3 Partial perspective view of a packing provided for a hand insertion window of the incubator according to the embodiment of the present invention.
Figure 4:
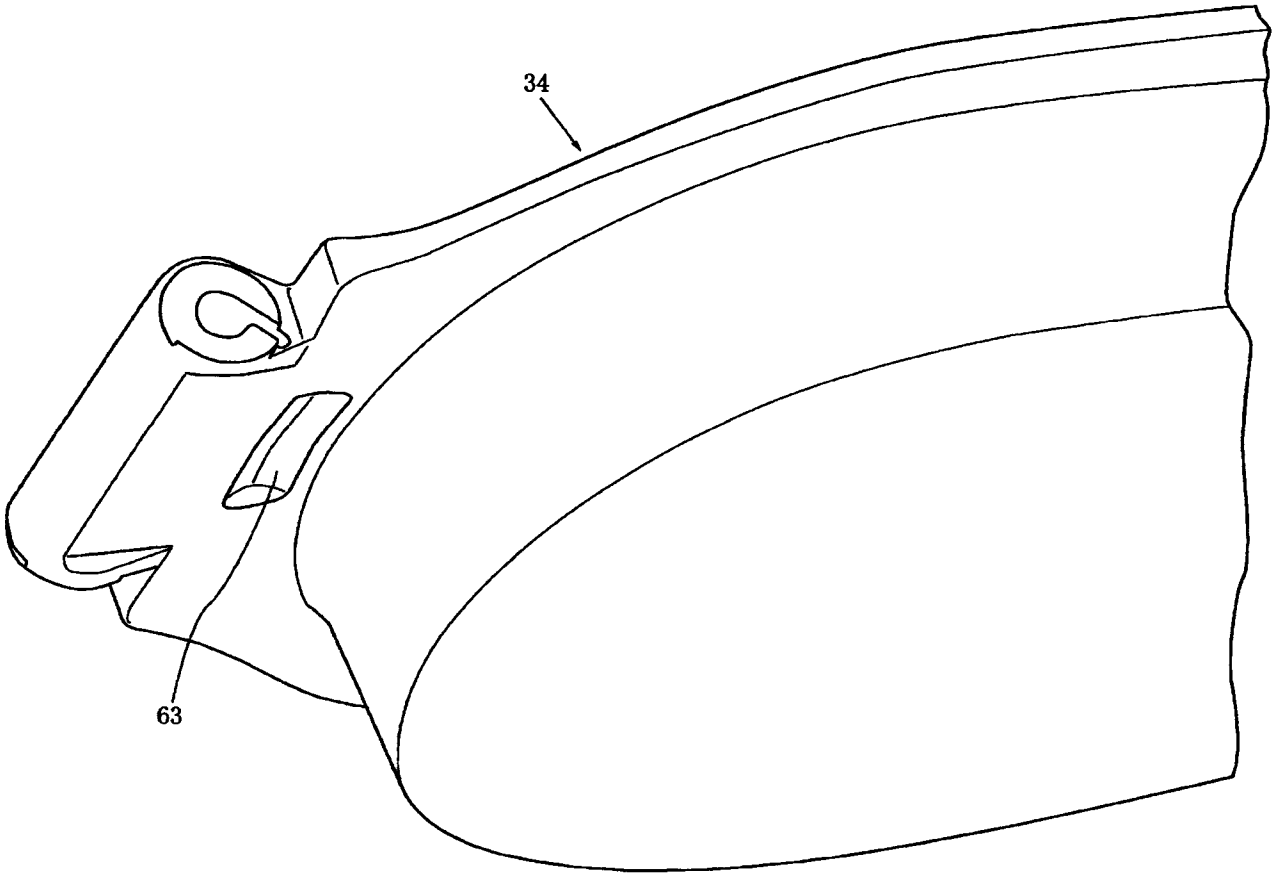
FIG. 4 Partial perspective view of a hand insertion door of the incubator according to the embodiment of the present invention.

As shown in FIG. 10 (*b*), a packing 56 of annular shape and made of silicone rubber is fitted along the internal edge of the hand-insertion-door base plate 36. As shown in FIG. 3, most of the portion of the packing 56 that is in contact with the hand insertion door 34 closing the hand insertion window 33 is a fin-shaped portion 57 but the portion of the packing 56 near the rotation shaft 37 of the hand insertion door 34 is a thicker portion 61. Disposed on the thicker portion 61 is a projection 62 that prevents the packing 56 from being erroneously attached. As shown in FIG. 4, a recess 63 into which the projection 62 fits is formed in the hand insertion door 34 near the rotation shaft 37.

When the hand insertion door 34 is rotated from the state in which the hand insertion door 34 opens the hand insertion window 33 to the state in which the hand insertion door 34 closes the hand insertion window 33, the hand insertion door 34 comes into contact with the packing 56 before the hand insertion door 34 closes the hand insertion window 33. When the hand insertion door 34 is further rotated, the hand insertion door 34 presses and elastically deforms the packing 56 before the latch 41 holds the hand insertion door 34. This elastic deformation ensures airtight condition by the packing 56. Additionally, elastic resilience is produced especially in the thicker portion 61 and projection 62 of the packing 56. This elastic resilience urges the hand insertion door 34 in the direction in which the hand insertion window 33 is opened.

Accordingly, if the hand insertion window 33 is not completely closed by the hand insertion door 34 due to such a situation that a treating person recognizes erroneously that the hand insertion window 33 is closed although the hand insertion window 33 is not actually completely closed, or due to any other reason, the hand insertion door 34 is rotated in the direction in which the hand insertion window 33 is opened. For this reason, it is easily aware that the hand insertion window 33 is not closed, and the hand insertion window 33 is more likely to be again closed. Incidentally, the hand insertion door 34 is urged from the closing position to the opening position by the helical coil spring 38. If, however, this urging force is too strong, the hand insertion door 34 may rotate suddenly. The urging force applied from the helical coil spring 38, therefore, should not be very strong.

(4) Making Operation of Opening and Closing the Hand Insertion Window Quiet

Figure 6:
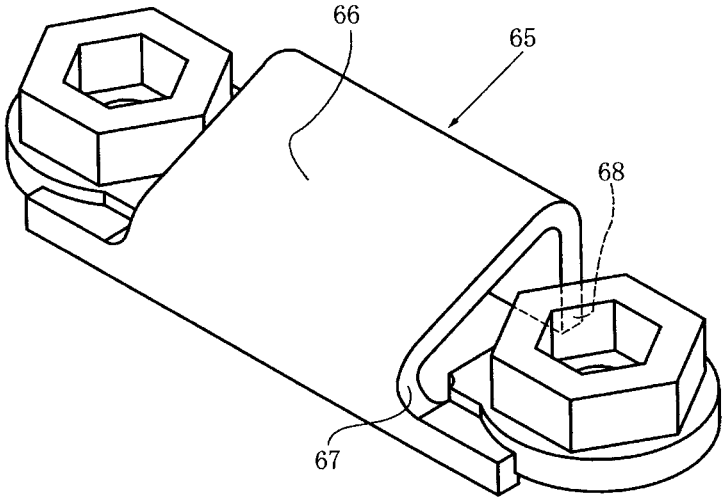
FIG. 6 Perspective view of a braking mechanism of the incubator according to the embodiment of the present invention.

The pressed portion 55 of the latch 41 is made of silicone rubber. Additionally, as shown in FIG. 1, a spacer 64 is interposed between the latch 41 and the latch base plate 42 and about the rotation shaft 44. Rotation of the latch 41 by the urge applied from the helical coil spring 45 is braked by the spacer 64. On the other hand, as shown in FIGS. 5 and 6, a braking mechanism 65 made of synthetic resin is mounted on the hand-insertion-door base plate 36. A lower-side edge 67 of an inclining face 66 is formed integrally with the other portion of the braking mechanism 65 whereas an upper-side edge 68 of the inclining face 66 is a free edge.

As shown in FIG. 5, a portion near the braking mechanism 65 around the rotation shaft 37 of the hand insertion door 34 is not completely circular in its cross-section but has a cross-section with radius such that when the hand insertion door 34 closes the hand insertion window 33, the portion near the braking mechanism 65 is separated from the inclining face 66 of the braking mechanism 65, and when the hand insertion door 34 opens the hand insertion window 33, the portion approaches the inclining face 66, comes into contact with the inclining face 66 in the course of the opening of the hand insertion window 33, and consequently presses the inclining face 66. When the inclining face 66 is thus pressed, the braking mechanism 65 is elastically deformed so that the upper-side edge 68 is moved farther from the lower-side edge 67 and that the height of the inclining face 66 is decreased, and the pressing force is absorbed.

When the hand insertion door 34 is rotated from the state in which the hand insertion window 33 is opened as shown in FIG. 5 to the state in which the opening 33 is closed, the tongue portion 54 of the hand insertion door 34 first comes into contact with the pressed portion 55 of the latch 41 as shown in FIG. 7. However, since the pressed portion 55 is made of silicone rubber, impact is less likely to occur even if the tongue portion 54 comes into contact with the pressed portion 55 with great force. When the hand insertion door 34 is further rotated from the state shown in FIG. 7, the pressed portion 55 is pressed and thereby the latch 41 rotates up to the releasing position as shown in FIG. 8. When the hand insertion door 34 is further rotated, the tongue portion 54 enters the latch 41 as shown in FIG. 9.

When the tongue portion 54 enters the latch 41 and thereby the pressed portion 55 gets not to be pressed by the tongue portion 54, the latch 41 rotates from the releasing position to the holding position by the urge applied from the helical coil spring 45 and holds the tongue portion 54. However, since rotation of the latch 41 due to the urge applied from the helical coil spring 45 is braked by the spacer 64, the latch 41 is prevented from rotating with great force and, hence, impact is less likely to occur when the rotation comes to an end.

On the other hand, when the releasing member 43 is operated and thereby the tongue portion 54 of the hand insertion door 34 is released from being held by the latch 41, the urging force due to elastic resilience of the packing 56, especially of its thicker portion 61 and projection 62, and the urging force applied from the helical coil spring 38 act in the following manner: the hand insertion door 34 rotates from the state in which the hand insertion window 33 is closed as shown in FIGS. 9 and 10, through the state as shown in FIG. 8, to the state in which the hand insertion window 33 is opened as shown in FIG. 5. However, the braking mechanism 65 brakes the rotation of the hand insertion door 34 in the course of opening the hand insertion window 33, and impact is less likely to occur when the rotation comes to an end.

In the foregoing embodiment, the pressed portion 55 of the latch 41 is made of silicone rubber. However, the pressed portion 55 may be made of any impact-absorbent material in lieu of silicone rubber. Likewise, the packing 56 is also made of silicone rubber. However, the packing 56 may be made of any elastically resilient material in lieu of silicone rubber. Additionally, the foregoing embodiment is applied to a switching type incubator but it may also be applied to a closed type incubator.

INDUSTRIAL APPLICABILITY

The present invention can be utilized for, for example, manufacturing an incubator that includes: a hand insertion window in a side of a newborn chamber, a hand insertion door that opens and closes the hand insertion window, and a latch mechanism that holds the hand insertion door in a closing position.

REFERENCE SIGNS LIST

11 Incubator
16 Newborn chamber
33 Hand insertion window
34 Hand insertion door

35 Latch mechanism
37 Rotation shaft
38 Helical coil spring
41 Latch
42 Latch base plate
43 Releasing member
44 Rotation shaft
45 Helical coil spring (urging member)
46 Spiral face
51 Helical compression spring
55 Pressed portion
56 Packing
61 Thicker portion (opening mechanism)
62 Projection
64 Spacer (braking member)
65 Braking mechanism

The invention claimed is:

1. An apparatus comprising:

a hand insertion window formed in a side of a newborn chamber;

a hand insertion door that opens and closes the hand insertion window by rotation;

a latch mechanism that holds the hand insertion door in a closing position for closing the hand insertion window;

wherein the latch mechanism includes a latch and a releasing member, the latch has a rotation shaft extending along the side and enabling rotation between a holding position for the holding of the hand insertion door and an releasing position for releasing the holding of the hand insertion door, and a spiral face extending to at least part of a periphery of the rotation shaft; and the releasing member is movable along the side, and presses the spiral face by movement to cause the rotation of the latch from the holding position to the releasing position; and an opening mechanism configured such that in the course of the rotation of the hand insertion door in the direction in which the hand insertion window is closed, the opening mechanism comes into contact with the hand insertion door before the hand insertion window is closed, and thereby urges the hand insertion door to cause the rotation in the direction in which the hand insertion window is opened, wherein a packing is attached to an internal edge of the hand insertion window and the packing serves as the opening mechanism. further wherein the packing has a thicker portion and the thicker portion serves as the opening mechanism, wherein the latch has a pressed portion that is pressed by the rotation of the hand insertion door, and thereby causes the rotation from the holding position to the releasing position, and the pressed portion is made of impact-absorbent material.

2. The apparatus according to claim 1, further comprising a helical compression spring urging the releasing member in a direction opposite to the direction in which the spiral face is pressed.

3. The apparatus according to claim 1, wherein the impact-absorbent material is silicone rubber.

4. The apparatus according to claim 1, wherein the latch mechanism includes:

an urging member for urging the rotation of the latch from the releasing position to the holding position; and a braking member for braking slowing the rotation of the latch.

5. The apparatus according to claim 4, wherein the latch mechanism includes a latch base plate supporting the latch and the releasing member, and the braking member is a spacer disposed between the latch and the latch base plate and around the rotation shaft.

6. The incubator according to claim 1, wherein a packing is attached to an internal edge of the hand insertion window, and the packing serves as the opening device.

7. The incubator according to claim 6, wherein the packing is made of silicone rubber.

8. The incubator according to claim 6, wherein the packing has a thicker portion, and the thicker portion serves as the opening mechanism.

9. The apparatus according to claim 8, wherein disposed on the thicker portion is a projection for preventing the packing from being erroneously attached, and the thicker portion and the projection serve as the opening mechanism.

10. The apparatus according to claim 9, wherein a rotation shaft for the rotation of the hand insertion door is inserted in a helical coil spring, and the thicker portion, the projection, and the helical coil spring serve as the opening mechanism.

11. An apparatus comprising: a hand insertion window formed in a side of a newborn chamber;

a hand insertion door that opens and closes the hand insertion window by rotation;

a latch mechanism that holds the hand insertion door in a closing position for closing the hand insertion window;

wherein the latch mechanism includes a latch and a releasing member, the latch has a rotation shaft extending along the side and enabling rotation between a holding position for the holding of the hand insertion door and an releasing position for releasing the holding of the hand insertion door, and a spiral face extending to at least part of a periphery of the rotation shaft; and the releasing member is movable along the side, and presses the spiral face by movement to cause the rotation of the latch from the holding position to the releasing position; and a braking mechanism configured such that a portion of door around the shaft is not completely circular in cross section, so there will be a separation between the door and the braking mechanism, wherein when the door is moved to the open position, there is a time that there is no connection, and from the moment that the surface of the door makes contact with the braking mechanism to the open position, the braking mechanism is then capable of brake rotation of the door, and the braking mechanism is located next to the shaft of the door.

12. The apparatus according to claim 11, wherein a portion around a rotation shaft for the rotation of the hand insertion door has a cross-section that is not completely circular, and the cross-section comes into contact with the braking mechanism in the course of the rotation.

13. The apparatus according to claim 12, wherein the braking mechanism is elastically deformable, and by the elastic deformation, the braking mechanism absorbs pressure applied due to the contact.

* * * * *